United States Patent [19]

Hayes

[11] 4,079,764

[45] Mar. 21, 1978

[54] DECORATIVE NAIL SPACING TOOL

[76] Inventor: David G. Hayes, 911 SE. 50th Ave., Portland, Oreg. 97215

[21] Appl. No.: 753,732

[22] Filed: Dec. 23, 1976

[51] Int. Cl.[2] ..... B25C 3/00

[52] U.S. Cl. ..... 145/46

[58] Field of Search ..... 145/46

[56] References Cited

U.S. PATENT DOCUMENTS

| | | | |
|---|---|---|---|
| 488,510 | 12/1892 | Unbehend | 145/46 |
| 3,060,442 | 10/1962 | Tomek | 145/46 |

FOREIGN PATENT DOCUMENTS

| | | | |
|---|---|---|---|
| 827,926 | 1/1952 | Germany | 145/46 |
| 327,971 | 10/1920 | Germany | 145/46 |
| 5,414 of | 1893 | United Kingdom | 145/46 |

*Primary Examiner*—James L. Jones, Jr.
*Assistant Examiner*—J.T. Zatarga
*Attorney, Agent, or Firm*—Oliver D. Olson

[57] ABSTRACT

A tool for spacing decorative furniture nails comprises an elongated handle arranged for grasping by a user, joined angularly at one end to a planar gripping body which is configured for placement in overlying engagement with the edge of a piece of upholstery material to be nailed to a furniture frame. The gripping body has a substantially straight working edge, and a plurality of nail receiving openings are located at evenly spaced intervals in the gripping body a short distance inwardly from the working edge for frictionally engaging the shanks of nails. Flared slots, which extend from each opening outwardly to the working edge, are configured for communicating with the openings over slightly less than 180° of their periphery for capturing the shank of a nail in an opening and permitting its release upon pivoting of the body about an already set nail. Positioning cavities, located at each end of the gripping body, coplanar and evenly spaced with the openings, are configured for receiving the enlarged head of a nail for indexing the tool relative to an already set nail. A small support pad, having a single nail gripping slot, is located at the opposite end of the handle for engaging a single nail.

5 Claims, 3 Drawing Figures

DECORATIVE NAIL SPACING TOOL

BACKGROUND OF THE INVENTION

This invention relates to a tool for positioning and holding decorative nails while driving them through upholstery material into a furniture frame. In particular it relates to such a tool which positions the nails at evenly spaced intervals adjacent to either a straight or curved edge.

In the upholstery art decorative nails having enlarged ornamental heads are utilized for attaching upholstery material to a furniture frame. Since the nails are a part of the finished upholstery they necessarily should be evenly spaced along a line which remains substantially equi-distance from the edge of the material. To accomplish this, unaided, required time consuming layout of the nail locations prior to their installation. The process is further complicated due to the difficulty of grasping the large headed nail and holding it while it is being driven into the furniture.

Several prior art tools have been provided to accommodate faster, more accurate driving of nails at evenly spaced intervals. However, when these prior art tools are used for placing nails along a curved edge, the tool must be removed from the work and repositioned for each subsequent nail. Thus the speed that normally would be attainable by use of multiple nail locating openings is lost. Moreover, no accurate means is provided in these prior art tools for resetting the tool after each group of nails has been set. These factors have limited the usefulness and acceptance of the prior art tools.

SUMMARY OF THE INVENTION

In its basic concept, the decorative nail spacing tool of this invention provides a plurality of evenly spaced nail receiving openings which are opened to the edge of the tool by flared slots arranged to permit release of a nail from an opening in which it is retained, upon pivotal movement of the tool.

It is by virtue of the foregoing basic concept that the principal objective of this invention is achieved; namely to overcome the aforementioned disadvantages and limitations of nail spacing tools of the prior art.

Another object of this invention is to provide a nail spacing tool of the class described which has a positioning cavity for indexing the tool relative to the enlarged head of an already set nail.

Another object of this invention is to provide a nail spacing tool of the class described which presses the upholstery material against the furniture frame while the nail is being driven.

A further object of this invention is to provide a nail spacing tool of the class described which permits locating a single nail in a confined area.

A further object of this invention is to provide a nail spacing tool of the class described which is of simplified construction for economical manufacture, and is of rugged, unitary design permitting severe treatment in use.

The foregoing and other objects and advantages of this invention will appear from the following detailed description, taken in connection with the accompanying drawings of a preferred embodiment.

DESCRIPTION OF THE PREFERRED EMBODIMENT

Figure 1:
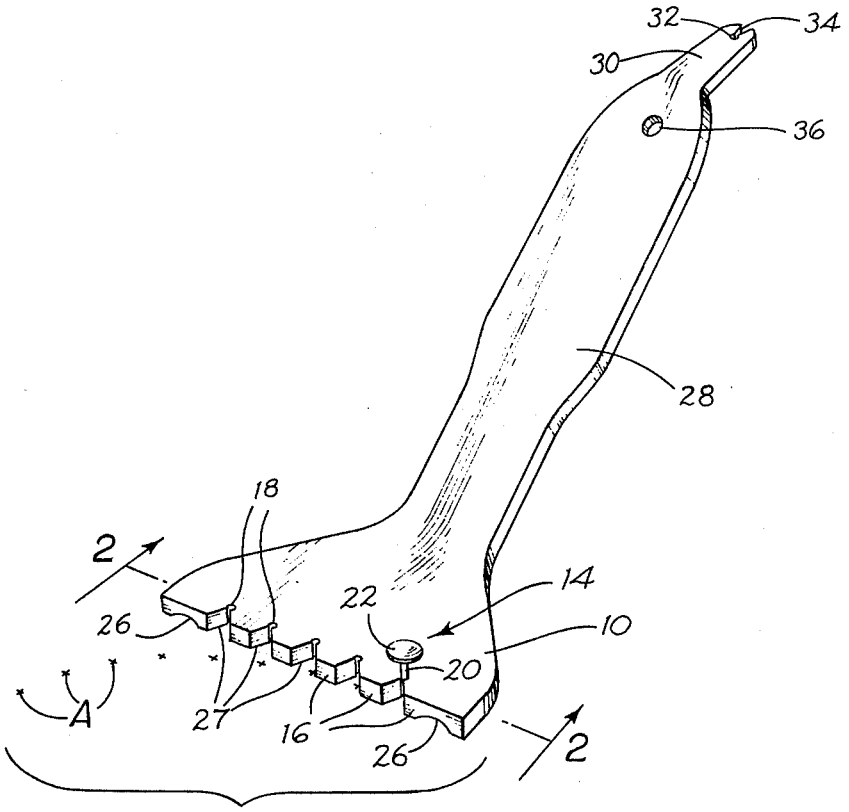
FIG. 1 is a perspective view of a nail setting tool embodying the features of this invention.
Figure 2:
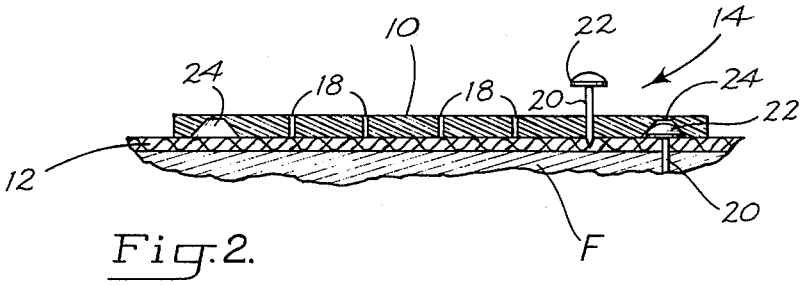
FIG. 2 is a fragmentary sectional view taken along the line 2—2 in FIG. 1.

Referring to FIG. 1 of the drawing, the tool comprises a planar gripping body 10 which is configured for placement over the edge of a segment of upholstery material 12 (FIG. 2) for supporting a decorative nail 14 while the nail is being driven through the upholstery material into an underlying furniture frame F.

To this end, the gripping body has an outwardly facing, substantially straight working edge 16. A plurality of nail receiving openings 18, passing through the gripping body, are disposed along a line which is parallel to the working edge. Preferably, the openings are located at evenly spaced longitudinal intervals approximately one-half inch laterally inwardly from the working edge and have diameters for frictionally receiving the shanks 20 of standard decorative furniture nails having enlarged decorative heads 22.

Located at at least one end of the gripping body, substantially coplanar with openings 18, is a downwardly facing positioning cavity 24 which is arranged for placement over the enlarged head 22 of a set decorative nail. In the embodiment illustrated, one positioning cavity 24 is located at each end of the gripping body and each is spaced from the adjacent opening 18 by the same distance as the openings are separated from each other. The positioning cavities comprise countersunk bores the axes of which are located on the line which extends through the openings 18. As indicated, the countersunk bores are quite large in diameter to accommodate decorative nails having quite large heads. The bores thus extend into the straight edge 16, as indicated by the open portions 26.

Located between each opening 20 and the working edge 16 is a flared slot 27 which permits release of the nail from the opening upon rearward or rotational movement of the tool. The slots communicate with the openings over a span of slightly less than 180° so that the nails normally are captured in the openings. However, when the tool is rotated or moved rearwardly the nails are pulled free of the openings.

Figure 3:
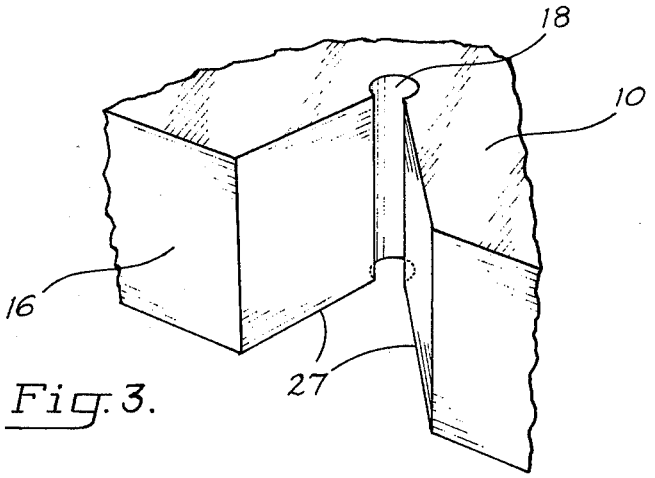
FIG. 3 is a fragmentary perspective view, at an enlarged scale, showing details of one of the openings and slots associated with the nails being set by the tool.

As best shown in FIGS. 1 and 3, the slots 27 are V-shaped. Thus when installing nails at points A along a curved line, each tool opening 18 is pulled free of the already set nail as the tool is progressively rotated for driving the succeeding nails. The V-shape of the slot then accommodates the shank of the nail so that it does not interfere with rotation of the tool.

An elongated handle 28 extends from the gripping body for manipulation of the tool by an operator. The handle is angled upwardly so that it is positioned conveniently for grasping by the operator when the gripping body is positioned flat on the upholstered surface.

Located at the outer end of the handle is a nail support pad 30 for holding a first nail while driving it, or for positioning a nail into a restricted location. The nail support pad preferably extends from the handle at the same angle as the gripping body, making the two elements parallel with each other. It is narrower than the gripping body and contains a single nail gripping opening 32 near its extremity. Extending between opening 32 and the outer end of pad 30 is a slot 34. It intersects the periphery of the opening 32 over a span slightly less than 180°, in manner similar to slots 27. However, slot 34 need not be as widely flared as slots 27, as will be apparent.

An opening 36 is provided in the handle near the support pad 30 for hanging the tool when it is not in use.

Preferably, the gripping body, the handle, and the support pad are formed integrally from a resilient synthetic resin material for ease and economy of fabrication.

The tool is used for holding the decorative furniture nails at uniformly spaced intervals while driving them through the upholstery material into the furniture frame.

A first nail 14 is started by placement in gripping opening 32 of support pad 30. The nail then is set by driving the shank 20 through the upholstery 12 and partially into the furniture frame. The tool then is disengaged from the nail and the latter driven further to bring the head 22 against the upholstery material.

The tool is used for spacing the subsequent nails relative to the first nail by placing one of the positioning cavities 24 over the head of the first nail. The next and subsequent nails are positioned in the appropriate openings 18 and partially driven into the furniture frame.

The tool then is removed from the nails by pulling it rearwardly, after which the nails are set completely. The tool then is translated laterally and the positioning cavity is positioned over the last set nail and the procedure is repeated. The opposite positioning cavity 24 is used when a row of nails is started on the other end.

Opening 32 in support pad 30 also is used when a nail must be placed into a restricted location.

When the nails are to be placed along a curved edge, such as the pattern shown by the points A in FIG. 1, a different procedure is used. A first nail is started, as above, and the tool is rotated about this nail until the next opening 18 registers with the curved line of points A. Each subsequent nail is started, one at a time, after intermediate sequential rotation of the tool about the next preceding nail. One opening 18 then is pulled free of its associated nail shank 14, the latter passing through slot 27 as the tool is rotated to its next position.

It will be noted that the angle at which the handle 28 is joined with gripping body 10 and support pad 30 permits easy manipulation of the tool in use. Also, with the gripping body positioned parallel with the upholstery material it presses the material against the furniture frame during nailing.

It willbe apparent to those skilled in the art that various changes may be made in the size, shape, number and arrangement of components described hereinbefore without departing from the spirit of this invention.

Having now described my invention and the manner in which it may be used, I claim:

1. A tool for spacing decorative furniture nails, comprising:

a. a planar gripping body arranged for placement in overlying engagement with the edge of a piece of furniture upholstery material, the gripping body having a substantially straight working edge, b. the gripping body having a plurality of nail-receiving openings extending therethrough for releasably gripping the shanks of decorative nails, the nail receiving openings being oriented in a spaced array along a line which is parallel to the working edge and inwardly adjacent thereto, c. a downwardly facing positioning cavity in the bottom surface of the gripping body arranged to fit over the head of a decorative nail, the positioning cavity being located adjacent an end of the working edge and on the line of the nail-receiving openings, and d. a handle extending from the gripping body for manipulation of the tool.

2. The tool of claim 1 wherein there are two positioning cavities, one located at each end of the gripping body on the line of the nail-receiving openings located therebetween.

3. The tool of claim 1 including a nail support pad attached to the end of the handle opposite the gripping body and having a nail gripping slot located at its terminal end, and wherein the handle extends at an upwardly facing angle from the gripping body and the support pad extends substantially parallel to the gripping body, the gripping body, support pad and handle being formed integrally of synthetic resin.

4. A tool for spacing decorative furniture nails, comprising:

a. a planar gripping body arranged for placement in overlying engagement with the edge of a piece of furniture upholstery material, the gripping body having a substantially straight working edge, b. the gripping body having a plurality of nail-receiving openings extending therethrough for releasably gripping the shanks of decorative nails, the nail-receiving openings being oriented in a spaced array along a line which is parallel to the working edge and inwardly adjacent thereto, c. the gripping body having a flared slot extending from each nail-receiving opening into the working edge for allowing withdrawal of the body from each nail upon rotation of the body about a center displaced from said nail, each of said flared slots being V-shaped with its inner end having a width slightly less than the diameter of the nail-receiving opening, and d. a handle extending from the gripping body for manipulation of the tool.

5. The tool of claim 4 including a nail support pad attached to the end of the handle opposite the gripping body and having a nail gripping slot located at its terminal end, and wherein the handle extends at an upwardly facing angle from the gripping body and the support pad extends substantially parallel to the gripping body, the gripping body, support pad and handle being formed integrally of synthetic resin.

* * * * *